US006575818B2

(12) United States Patent
Jeong

(10) Patent No.: US 6,575,818 B2
(45) Date of Patent: Jun. 10, 2003

(54) APPARATUS AND METHOD FOR POLISHING MULTIPLE SEMICONDUCTOR WAFERS IN PARALLEL

(75) Inventor: In Kwon Jeong, Sunnyvale, CA (US)

(73) Assignee: Oriol Inc., Santa Clara, CA (US)

( * ) Notice: Subject to any disclaimer, the term of this patent is extended or adjusted under 35 U.S.C. 154(b) by 0 days.

(21) Appl. No.: 09/894,567

(22) Filed: Jun. 27, 2001

(65) Prior Publication Data

US 2003/0003852 A1 Jan. 2, 2003

(51) Int. Cl.[7] ..... B24B 5/00
(52) U.S. Cl. ..... 451/285; 451/274; 451/280
(58) Field of Search ..... 451/28, 41, 56, 451/63, 285, 283, 286, 287, 288, 289, 272, 274, 280

(56) References Cited

U.S. PATENT DOCUMENTS 3,032,937 A * 5/1962 Day et al. ..... 451/282
3,377,750 A 4/1968 Day
4,020,600 A 5/1977 Day
5,562,524 A 10/1996 Gill, Jr.
5,649,854 A * 7/1997 Gill, Jr. ..... 451/290
5,816,891 A * 10/1998 Woo ..... 451/36
5,902,173 A * 5/1999 Tanaka ..... 451/287
5,924,916 A 7/1999 Yamashita
5,951,373 A * 9/1999 Shendon et al. ..... 451/285
6,019,671 A * 2/2000 Shendon ..... 451/288
6,062,954 A * 5/2000 Izumi ..... 451/285
6,343,979 B1 * 2/2002 Peltier et al. ..... 451/285
6,379,230 B1 * 4/2002 Hayashi et al. ..... 451/287
6,390,902 B1 * 5/2002 Chang et al. ..... 451/285
6,398,626 B1 * 6/2002 Matsuo et al. ..... 451/287
6,413,152 B1 * 7/2002 Sengupta et al. ..... 451/287

* cited by examiner

*Primary Examiner*—Joseph J. Hail, III
*Assistant Examiner*—Hadi Shakeri
(74) *Attorney, Agent, or Firm*—Wilson & Ham; Thomas H. Ham

(57) ABSTRACT

A chemical mechanical polishing (CMP) apparatus and method for polishing semiconductor wafers utilizes multiple wafer carriers to polish a corresponding number of semiconductor wafers on a single polishing pad in parallel. In one embodiment, the wafer carriers are used to transfer semiconductor wafers between one or more wafer transfer stations and the polishing pad. In other embodiments, one or more wafer transfer arms are used to transfer the semiconductor wafers between the wafer transfer station(s) and the wafer carriers. The CMP apparatus is configured to sequentially process semiconductor wafers to increase the throughput of the apparatus. In addition, the components of the CMP apparatus are arranged such that the footprint of the apparatus is minimized.

15 Claims, 7 Drawing Sheets

APPARATUS AND METHOD FOR POLISHING MULTIPLE SEMICONDUCTOR WAFERS IN PARALLEL

FIELD OF THE INVENTION

The invention relates generally to chemical mechanical polishing (CMP) systems, and more particularly to an apparatus and method for chemically and mechanically polishing multiple semiconductor wafers on a single polishing pad.

BACKGROUND OF THE INVENTION

During a fabrication process of a high density multi-layered semiconductor device, one of the most important processing steps is planarizing a layer of a semiconductor wafer by removing uneven topographic features of the wafer. The layer planarization allows patterns that are subsequently formed above that layer to be more uniform. In the case of conductive patterns, the planarization of the underlying layer reduces the probability of electrical shorts between the conductive patterns, which is a growing concern as the density of microelectronic circuitry included in a semiconductor device is progressively increased.

Chemical mechanical polishing (CMP) is a well-accepted technique to planarize a layer of a semiconductor wafer during the fabrication process by chemically and mechanically removing uneven topographic features of the wafer. A conventional CMP technique involves polishing the surface of a wafer with a rotating polishing pad using a slurry of colloidal particles in an aqueous solution. The slurry promotes planarization of the wafer surface by producing a chemical reaction with the wafer surface and by providing abrasives to "grind" the wafer surface with the polishing pad.

A common conventional CMP system utilizes a single wafer carrier and a single polishing pad to polish one semiconductor wafer at a time. However, CMP systems have been developed that can simultaneously polish multiple semiconductor wafers on one or more polishing pads to increase throughput. U.S. Pat. No. 5,498,199 to Karlsrud et al. describes a CMP apparatus that utilizes a multi-head wafer polish assembly with five wafer carriers to simultaneously polish five multiple semiconductor wafers on a single large polishing pad. In operation, five semiconductor wafers are sequentially placed on five loading cups of an index table, which is situated adjacent to the polishing pad. When all of the semiconductor wafers are in place, the loading cups are raised to attach the wafers onto the wafer carriers of the multi-head wafer polish assembly, which are positioned over the loading cups. The multi-head wafer polish assembly is then moved to the polishing pad, where all five semiconductor wafers are polished on the polishing pad. After the polishing, the multi-head wafer polish assembly is transferred back to the index table, where the polished semiconductor wafers are placed on five unloading cups of the index table. The loading cups and the unloading cups are situated on the index table in an alternating fashion, forming a circle of ten loading/unloading cups. The polished semiconductor wafers are then sequentially unloaded from the unloading cups.

A disadvantage of the CMP apparatus of Karlsrud et al. is that a significant amount of time is required to sequentially load new semiconductor wafers onto the loading cups before the wafers can be polished. During this period, the polishing pad remains idle. In addition, similar amount of time is required to sequentially unload polished semiconductor wafers from the unloading cups. Thus, the polishing process of the CMP apparatus of Karlsrud et al. includes substantial idle periods, which potentially decreases the throughput of the apparatus. Furthermore, the index table of the loading and unloading cups occupies a significant amount of space, which increases the footprint of the CMP apparatus.

U.S. Pat. No. 5,738,574 to Tolles et al. describes a CMP apparatus that can simultaneously polish three semiconductor wafers using multiple polishing pads. The CMP apparatus of Tolles et al. includes three polishing stations and a wafer transfer station, which are located at different quadrants about a rotational axis. Each polishing station includes a single polishing pad to polish a semiconductor wafer. The apparatus also includes four wafer carriers that are suspended from a carousel. The carousel is configured to rotate the wafer carriers such that each wafer carrier can be sequentially positioned at each of the four stations. In operation, the three semiconductor wafers on the wafer carriers positioned at the three polishing stations are polished by the polishing pads at the polishing stations. During this period, the semiconductor wafer on the wafer carrier positioned at the wafer transfer station is unloaded and a new semiconductor wafer is loaded onto that wafer carrier. After a predefined polishing period, the wafer carriers are rotated such that each wafer carrier is positioned at a subsequent station. Once the wafer carriers are properly positioned, the three semiconductor wafers at the polishing stations are polished, while the fourth semiconductor wafer at the transfer station is unloaded and a new semiconductor wafer is loaded. In this fashion, semiconductor wafers can be continuously processed by the apparatus such that each semiconductor wafer is sequentially polished at the three polishing stations.

Another CMP apparatus that can simultaneously polish multiple semiconductor wafers using multiple polishing pads is described in U.S. Pat. No. 6,136,715 to Shendon et al. The CMP apparatus of Shendon et al. includes a first polishing station, a second polishing station and a wafer transfer station. The first polishing station includes a large polishing pad, while the second polishing station includes a smaller polishing pad. The apparatus also includes multiple wafer carriers that are suspended from a rotatable carousel. In one embodiment, the apparatus includes four wafer carriers. The carousel is configured to rotate the wafer carriers such that each wafer carrier can be sequentially positioned at four locations. Two of the four locations coincide with the transfer station and the second polishing station. The remaining two locations are both at the first polishing station. In operation, the three semiconductor wafers on the wafer carriers positioned at the two polishing stations are polished by the two polishing pads at the polishing stations. Thus, two wafers are polished at the first polishing station. During this period, the semiconductor wafer on the wafer carrier positioned at the wafer transfer station is unloaded and a new semiconductor wafer is loaded onto that wafer carrier. After a predefined polishing period, the wafer carriers are rotated such that each wafer carrier is positioned at a subsequent location. Once the wafer carriers are properly positioned, the three semiconductor wafers at the polishing stations are polished, while the fourth semiconductor wafer at the transfer station is unloaded and a new semiconductor wafer is loaded. This cycle is repeated to sequentially polishing additional semiconductor wafers.

A concern with the above-described CMP apparatuses with multiple polishing pads is that the time required to unload a polished semiconductor wafer and then to load a new semiconductor wafer at the wafer transfer station is typically shorter in duration than the polishing time at the polishing stations. Thus, the new semiconductor wafer must remain idle until end of the polishing time. Consequently, valuable processing time is wasted at the transfer station for each semiconductor wafer to be polished.

In view of the above concerns, there is a need for an apparatus and method for chemically and mechanically polishing semiconductor wafers that provides increased efficiency and reduced footprint for the apparatus.

SUMMARY OF THE INVENTION

A chemical mechanical polishing (CMP) apparatus and method for polishing semiconductor wafers utilizes multiple wafer carriers to polish a corresponding number of semiconductor wafers on a single polishing pad in parallel. In one embodiment, the wafer carriers are used to transfer semiconductor wafers between one or more wafer transfer stations and the polishing pad. In other embodiments, one or more wafer transfer arms are used to transfer the semiconductor wafers between the wafer transfer station(s) and the wafer carriers. The CMP apparatus is configured to sequentially process semiconductor wafers to increase the throughput of the apparatus. In addition, the components of the CMP apparatus are arranged such that the footprint of the apparatus is minimized.

A CMP apparatus in accordance with the invention includes an object transfer station that is configured to sequentially receive objects, a polishing pad having a polishing surface to polish the objects, and a transferring mechanism for sequentially transferring the objects between the object transfer station and the polishing pad to exclusively polish the objects on the polishing pad. The transferring mechanism is configured to transfer at least two current objects from the object transfer station to different locations of the polishing pad such that the two current objects can be simultaneously polished on the polishing surface of the polishing pad.

The CMP apparatus may further include a pad conditioning system. The pad conditioning system includes a first pad conditioner and a second pad conditioner that are configured to selectively engage the polishing surface of the polishing pad to condition the polishing pad. In an embodiment, the CMP apparatus further includes an object unload station that is vertically positioned with respect to the object transfer station. The object unload station is configured to exclusively receive the objects that have been polished.

In one embodiment, the transferring mechanism includes a first object carrier and a second object carrier that are each configured to secure one of the objects to be polished. In this embodiment, the transferring mechanism may further include a first mechanical arm that is connected to the first object carrier and a second mechanical arm that is connected to the second object carrier. The first mechanical arm is configured to transfer the first object carrier between the object transfer station and the polishing pad, while the second mechanical arm is configured to transfer the second object carrier between the object transfer station and the polishing pad.

In other embodiments, the CMP apparatus includes first and second object carriers that are positioned about the polishing surface of the polishing pad to engage the polishing surface of the polishing pad. Each of the first and second object carriers is configured to secure one of the objects to be polished. In these embodiments, the transferring mechanism may include an object transfer arm that is configured to transfer some of the objects between the object transfer station and the first object carrier and to transfer some of the objects between the object transfer station and the second object carrier. Alternatively, the transferring mechanism may include a first object transfer arm and a second object transfer arm. The first object transfer arm is configured to exclusively transfer some of the objects between the object transfer station and the first object carrier, while the second object transfer arm is configured to exclusively transfer some of the objects between the object transfer station and the second object carrier.

A method of polishing surfaces of objects in accordance with the invention includes the steps of sequentially receiving a first object and a second object at an object transfer station, sequentially transferring the first and second objects from the object transfer station to different locations on a polishing surface of a polishing pad, exclusively polishing the first and second objects on the polishing surface of the polishing pad, and sequentially outputting the first and second objects that have been polished on the polishing surface of the polishing pad.

The method may include a step of conditioning the polishing pad using a first pad conditioner and a second pad conditioner. In an embodiment, the step of conditioning the polishing pad includes selectively scanning the polishing surface of the polishing pad with only one of the first and second pad conditioners.

In one embodiment, the step of sequentially transferring the first and second objects includes directly transferring the first and second objects from the object transfer station to the different locations on the polishing surface of the polishing pad using a first object carrier and a second object carrier. In other embodiments, the step of sequentially transferring the first and second objects includes transferring the first object from the object transfer station to a first object carrier and transferring the second object from the object transfer station to a second object carrier. In these other embodiments, the first and second object carriers are positioned about the polishing surface of the polishing pad. In one embodiment of the other embodiments, the step of transferring the first object from the object transfer station to the first object carrier and the step of transferring the second object from the object transfer station to the second object carrier are performed by a single object transfer arm. In another embodiment of the other embodiments, the step of transferring the first object from the object transfer station to the first object carrier is performed by a first object transfer arm and the step of transferring the second object from the object transfer station to the second object carrier is performed by a second object transfer arm. In these other embodiments, the step of sequentially outputting the first and second objects may include transferring the first and second objects to an object unload station, which is vertically positioned with respect to the object transfer station.

Other aspects and advantages of the present invention will become apparent from the following detailed description, taken in conjunction with the accompanying drawings, illustrated by way of example of the principles of the invention.

DETAILED DESCRIPTION OF THE INVENTION

Figure 1:
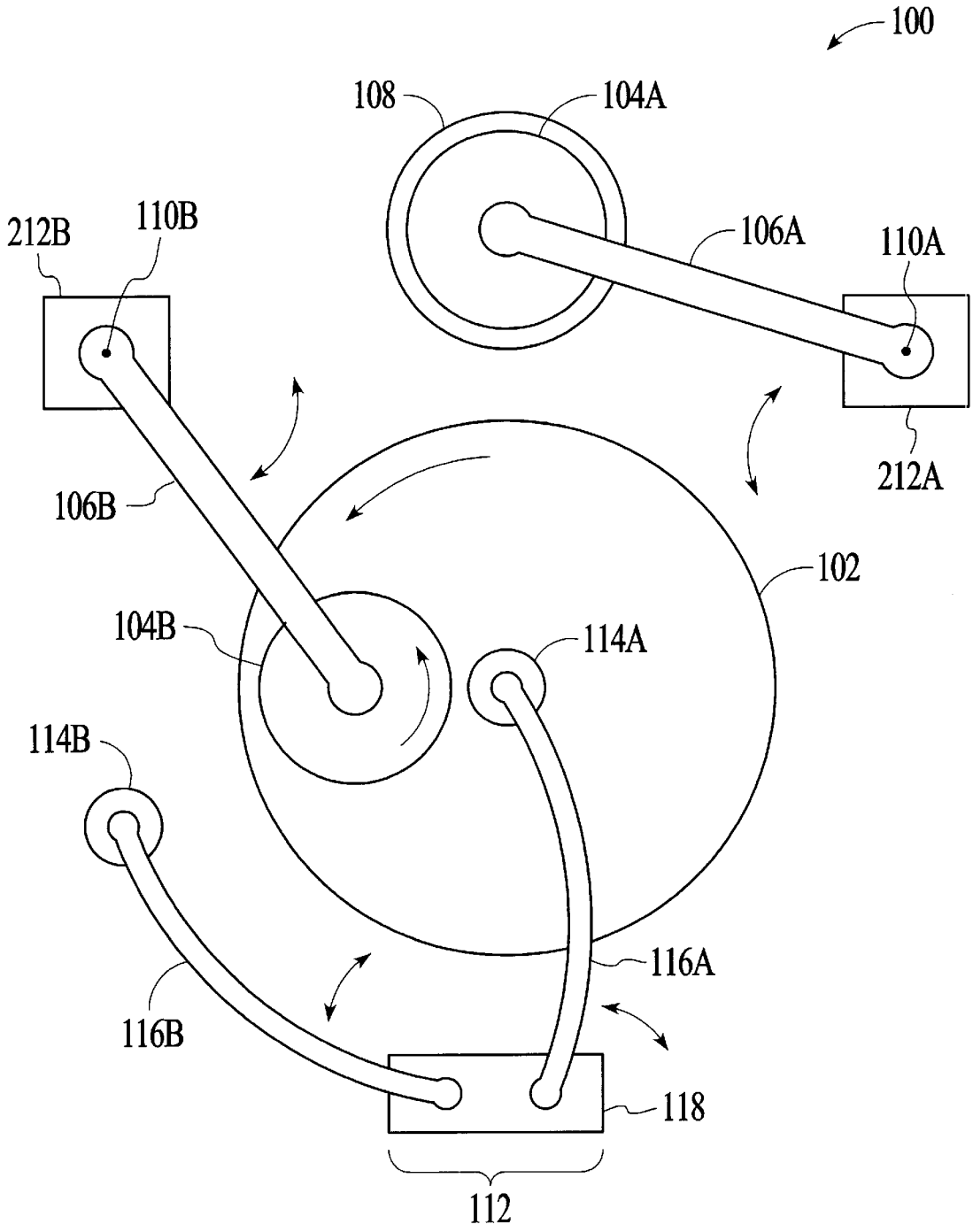
FIG. 1 is a top view of a chemical mechanical polishing (CMP) apparatus in accordance with a first embodiment of the present invention.
Figure 2:
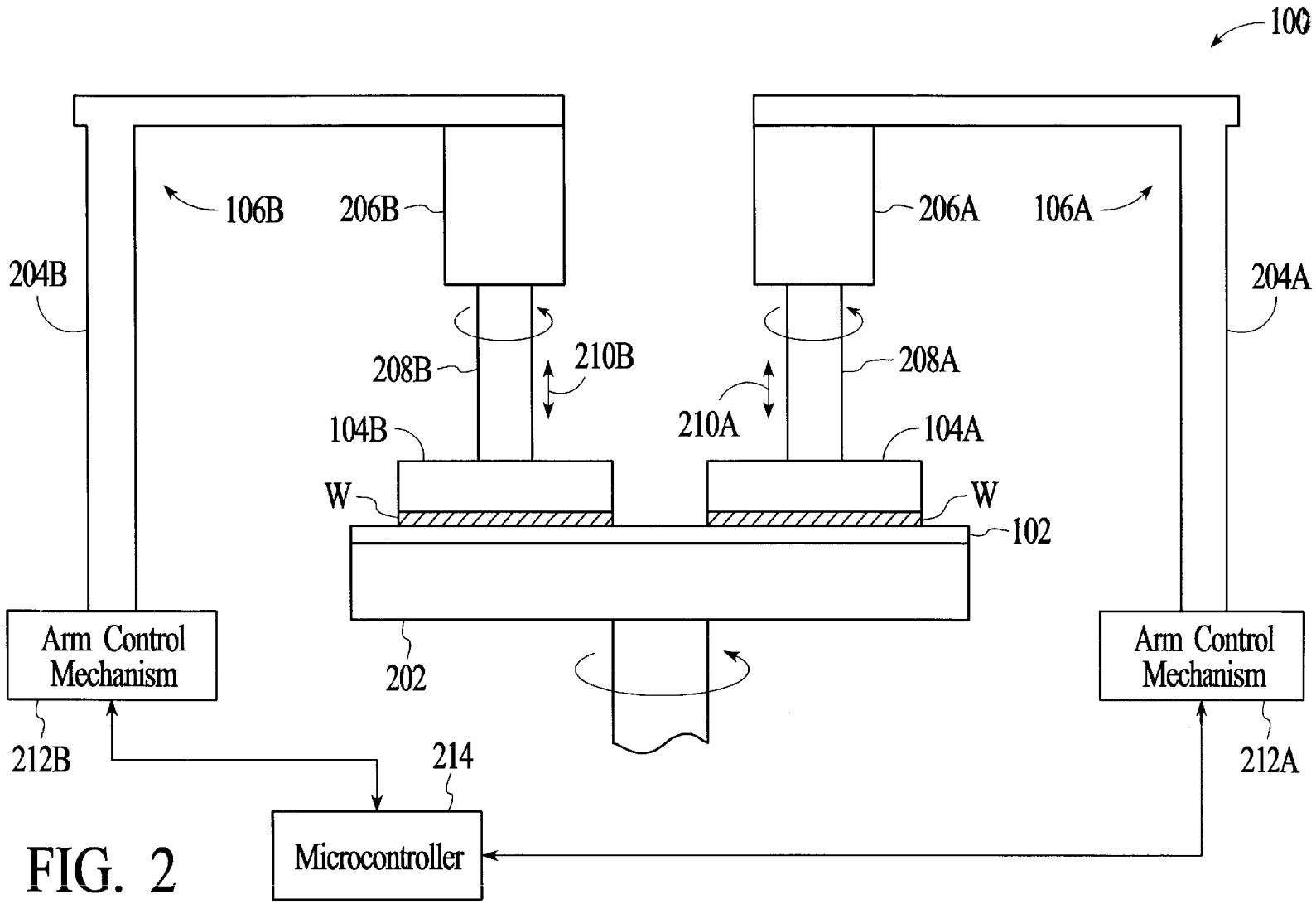
FIG. 2 is a side view of the CMP apparatus of FIG. 1.

With reference to FIGS. 1 and 2, a CMP apparatus 100 in accordance with a first embodiment of the present invention is shown. FIG. 1 is a top view of the CMP apparatus, while FIG. 2 is a side view of the CMP apparatus. The CMP apparatus operates to process two semiconductor wafers in parallel such that approximately twice as many semiconductor wafers can be polished as compared to a conventional CMP apparatus that sequentially processes semiconductor wafers one wafer at a time. However, the CMP apparatus 100 is designed such that footprint of the apparatus is only nominally increased.

The CMP apparatus 100 utilizes a single polishing pad 102 that can accommodate two wafer carriers 104A and 104B. Thus, two semiconductor wafers W can be simultaneously polished on different locations of the polishing surface of the polishing pad using the two wafer carriers, as illustrated in FIG. 2. The polishing pad is situated on a rotatable base 202, as shown in FIG. 2. Thus, the polishing pad can be rotated by the rotatable base. The polishing pad may be any type of polishing pad that can be used to polish a surface of a semiconductor wafer. As an example, the polishing pad may be of the type that contains abrasive particles on the pad surface.

The wafer carriers 104A and 104B of the CMP apparatus 100 are connected to mechanical arms 106A and 106B, respectively, that can sequentially move the wafer carriers between the polishing pad 102 and a wafer unload/load transfer station 108. As shown in FIG. 2, the mechanical arm 106A comprises an arm frame 204A, a rotational-and-vertical drive mechanism 206A, and an arm shaft 208A. The arm shaft 208A connects the wafer carrier 104A to the rotational-and-vertical drive mechanism 206A, which is attached to the arm frame 204A. The rotational-and-vertical drive mechanism 206A is configured to rotate the wafer carrier 204A by rotating the arm shaft 208A. Furthermore, the rotational-and-vertical drive mechanism 206A is configured to raise and lower the wafer carrier 204A by moving the arm shaft 208A along the vertical direction, as indicated by the arrow 210A. Thus, the rotational-and-vertical drive mechanism 208A is able to control the pressure being applied on the polishing pad 102 by the semiconductor wafer W on the wafer carrier 104A. The arm frame 204A of the mechanical arm 106A is connected to an arm control mechanism 212A, which is configured to pivot the arm frame about a fixed axis 110A, as shown in FIG. 1. Thus, the arm control mechanism 210A controls the lateral positioning of the wafer carrier 104A by pivoting the arm frame 204A.

The mechanical arm 106B also comprises an arm frame 204B, a rotational-and-vertical drive mechanism 206B and an arm shaft 208B that are connected in the same manner as the corresponding components of the mechanical arm 106A. Similar to the mechanical arm 106A, the rotational-and-vertical drive mechanism 206B of the mechanical arm 106B is configured to rotate the wafer carrier 204B by rotating the arm shaft 208B, and is also configured to raise and lower the wafer carrier 204B by moving the arm shaft 208B along the vertical direction, as indicated by the arrow 210B. Furthermore, the arm frame 204B of the mechanical arm 106B is connected to an arm control mechanism 212B, which is configured to pivot the arm frame 204B about a fixed axis 110B, as shown in FIG. 1. Thus, the arm control mechanism 212B controls the lateral positioning of the wafer carrier 104B by pivoting the arm frame 204B.

Since the wafer carriers 104A and 104B are attached to different mechanical arms 106A and 106B, each of the wafer carriers can be independently manipulated. Thus, each of the wafer carriers can be independently transferred between the wafer unload/load transfer station 108 and the polishing pad 102, as long as the other wafer carrier is not in the path of the moving wafer carrier. In addition, each of the wafer carriers can also be independently raised and lowered to selectively engage the wafer unload/load transfer station or the polishing pad. Furthermore, each of the wafer carriers can be independently rotated to individually polish semiconductor wafers.

The wafer unload/load transfer station 108 of the CMP apparatus 100 is configured to accommodate one semiconductor wafer at a time. The wafer unload/load transfer station operates to sequentially receive semiconductor wafers to be polished, for example, from a supply of semiconductor wafers (not shown). These semiconductor wafers are then sequentially transferred to the polishing pad 102 for polishing by the wafer carriers 104A and 104B. The polished semiconductor wafers are sequentially returned to the wafer unload/load transfer station by the wafer carriers, where the polished wafers are then transmitted to the next destination, for example, a post-CMP cleaning system (not shown). Thus, the wafer unload/load transfer station operates as both the ingress and the egress for the CMP apparatus.

Turning back to FIG. 1, the CMP apparatus 100 further includes a pad conditioning system 112. The pad conditioning system includes a pair of pad conditioners 114A and 114B that are connected to arms 116A and 116B. The underlying surfaces of the pad conditioners may include known pad conditioner material, such as embedded diamond particulates or plastic bristles, to deglaze the surface of the polishing pad 102. The arms of the pad conditioning system are connected to a drive mechanism 118, which controls the independent lateral movements of the arms across the surface of the polishing pad. Thus, each of the pad conditioners can be independently scanned over the surface of the polishing pad to condition the polishing pad. The drive mechanism also independently controls the vertical movements of the arms to ensure that sufficient pressure on the polishing pad is being applied by the pad conditioners 114A and 114B for pad conditioning. The pad conditioning system also includes rotational drive mechanisms (not shown) that are connected to the pad conditioners to independently rotate the pad conditioners during pad conditioning.

In operation, one of the pad conditioners 114A and 114 is selected to condition the polishing pad 102. If the wafer carrier 104A is moved to the wafer unload/load transfer station 108, then the pad conditioner 114A is selected. However, if the wafer carrier 104B is moved to the wafer unload/load transfer station, then the pad conditioner 114B is selected. The drive mechanism 118 of the pad conditioning system 112 pivots the arm 116 that is attached to the selected pad conditioner, e.g., the pad conditioner 114A, so that the pad conditioner is laterally moved across the polishing pad, as illustrated in FIG. 1. When the selected pad conditioner is positioned over the polishing pad, the drive mechanism may also lower the pad conditioner to ensure that sufficient pressure is being applied onto the polishing pad by the pad conditioner for proper conditioning. After the polishing pad is conditioned by the selected pad conditioner, the above-described operation is repeated to condition the polishing pad with the other pad conditioner, e.g., the pad conditioner 114B.

As shown in FIG. 2, the CMP apparatus 100 also includes a microcontroller 214 that is connected to the arm control mechanisms 212A and 212B. The microcontroller controls the arm control mechanisms, as well as the rotational-and-vertical drive mechanisms 206A and 206B of the mechanical arms 106A and 106B. Thus, the microcontroller is able to control the lateral and vertical movements of the wafer carriers 104A and 104B and the rotational speeds of the wafer carriers. The microcontroller may also control the rotation of the polishing pad 102 and the operation of the pad conditioning system 112.

The wafer processing operation of the CMP apparatus 100 is now described. Initially, the wafer carriers 104A and 104B may be positioned over the polishing pad 102, as illustrated by the wafer carrier 104B in FIG. 1. The wafer processing operation begins when a first semiconductor wafer is received at the wafer unload/load transfer station 108 from an external source, e.g., a wafer cassette. The first semiconductor wafer may be transmitted to the wafer unload/load transfer station using any conventional method, such as a wafer transfer arm for transporting a semiconductor wafer. Next, one of the mechanical arms 106A and 106B, e.g., the mechanical arm 106A, is pivoted by the arm control mechanism 212A to position the wafer carrier 104A over the wafer unload/load transfer station. The wafer carrier 104A is then lowered by the rotational-and-vertical drive mechanism 206A of the mechanical arm 106A to secure the first semiconductor wafer onto the bottom of the wafer carrier. As an example, the first semiconductor wafer may be secured to the wafer carrier 104A using a vacuum. The wafer carrier 104A is then raised along with the first semiconductor wafer and transferred back to the polishing pad 102, where the first semiconductor wafer is polished. The first semiconductor wafer is polished by engaging the first semiconductor wafer to the surface of the polishing pad, during which the wafer is rotated by the wafer carrier 104A and the polishing pad is rotated by the rotatable base 202.

After the first semiconductor wafer is removed from the wafer unload/load transfer station 108 by the wafer carrier 104A, a second semiconductor wafer is received at the wafer unload/load transfer station. The other mechanical arm, e.g., the mechanical arm 106B, is then pivoted by the arm control mechanism 212B to position the wafer carrier 104B over the wafer unload/load transfer station. The mechanical arm 106B is pivoted when the wafer carrier 104A is positioned over the polishing pad 102 to ensure that the wafer carriers 104A and 104B do not collide while being transferred between the wafer unload/load transfer station and the polishing pad. The wafer carrier 104B is then lowered by the rotational-and-vertical drive mechanism 206B of the mechanical arm 106B to secure the second semiconductor wafer onto the bottom of the carrier. The wafer carrier 104B is then raised along with the second semiconductor wafer and transferred back to the polishing pad, where the second semiconductor wafer is simultaneously polished on the polishing pad along with the first semiconductor wafer.

The first and second semiconductor wafers are polished on the polishing pad 102 for a predefined polishing period. However, the polishing of the first semiconductor wafer begins prior to the polishing of the second semiconductor wafer. Thus, the polishing period for the first wafer is terminated before the polishing period for the second wafer. At the end of the polishing period, the first semiconductor wafer is removed from the polishing pad and transferred back to the wafer unload/load transfer station 108 by laterally moving the wafer carrier 104A from the polishing pad to the wafer unload/load transfer station using the pivoting motion of the mechanical arm 106A. The polished first semiconductor wafer is then placed on the wafer unload/load transfer station, where the polished wafer is removed and transmitted to the next destination, for example, a post-CMP cleaning system (not shown). After the polished first semiconductor wafer is removed from the wafer unload/load transfer station, a third semiconductor wafer to be polished is received at the wafer unload/load transfer station. The third semiconductor wafer is then picked up by the wafer carrier 104A and processed in the same manner as the first semiconductor wafer.

At the end of the polishing period for the second semiconductor wafer, the second wafer is removed from the polishing pad 102 and transferred back to the wafer unload/load transfer station 108 by moving the wafer carrier 104B from the polishing pad to the wafer unload/load transfer station using the pivoting motion of the mechanical arm 106B. The polished second semiconductor wafer is then placed on the wafer unload/load transfer station, where the polished wafer is removed and transmitted to the next destination. After the polished second semiconductor wafer is removed from the wafer unload/load transfer station, a fourth semiconductor wafer to be polished is received at the wafer unload/load transfer station. The fourth semiconductor wafer is then picked up by the wafer carrier 104B and processed in the same manner as the second semiconductor wafer. In this fashion, the CMP apparatus 100 can continually process two semiconductor wafers in a parallel manner.

Concurrent to the processing of the semiconductor wafers, the polishing pad 102 is conditioned by the pad conditioning system 112. When the wafer carrier 104A is transferred to the wafer unload/load transfer station 108, the pad conditioner 114A is swept across the polishing pad to condition the pad, as illustrated in FIG. 1. Similarly, when the wafer carrier 104B is transferred to the wafer unload/load transfer station, the pad conditioner 114B is swept across the polishing pad to condition the pad. The polishing pad may be conditioned each time one of the wafer carriers is transferred to the wafer unload/load transfer station. Alternatively, the polishing pad may be conditioned less frequently. The frequency of the pad conditioning by the pad conditioners may be adjusted as needed.

Figure 3:
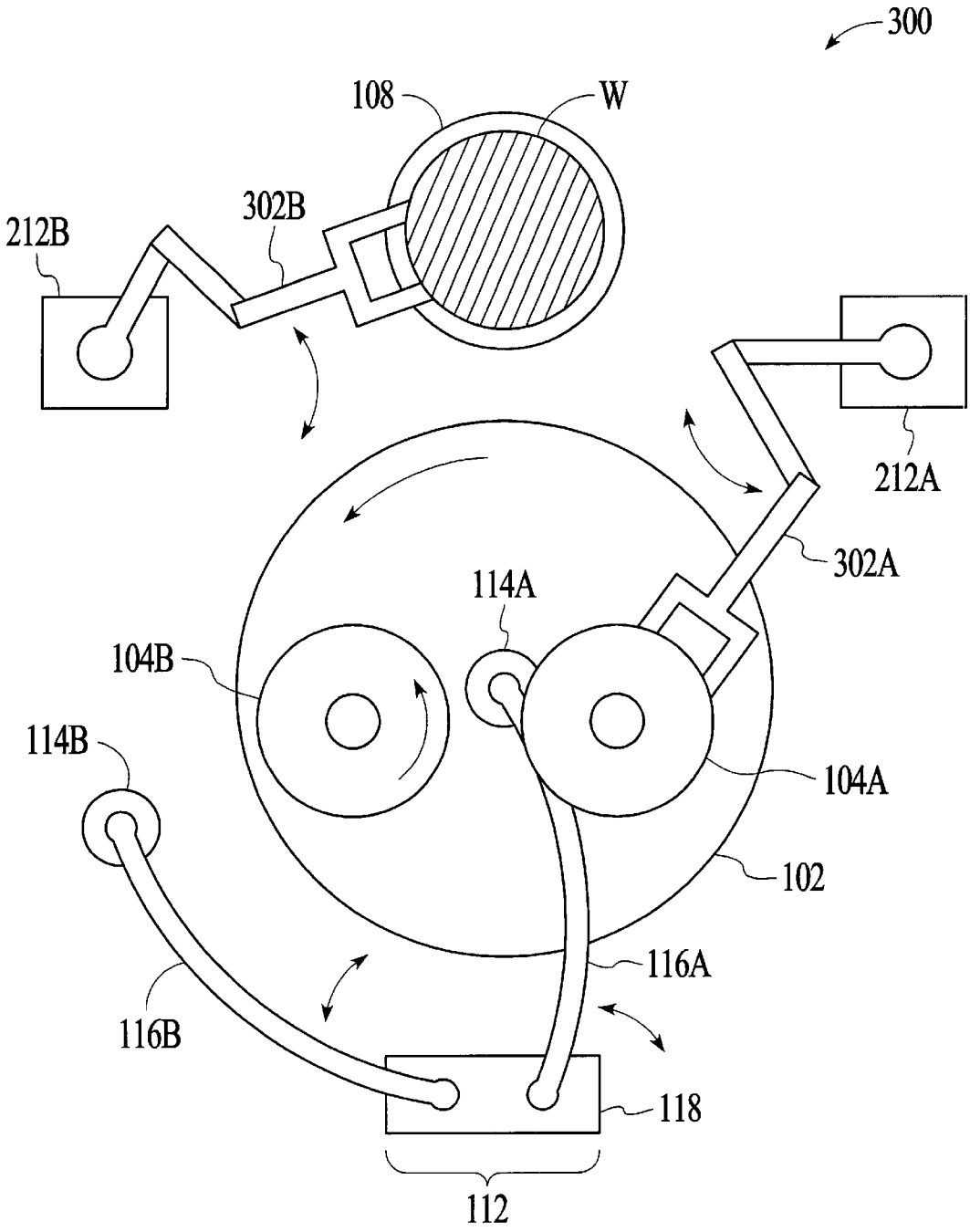
FIG. 3 is a top view of a CMP apparatus in accordance with a second embodiment of the invention.
Figure 4:
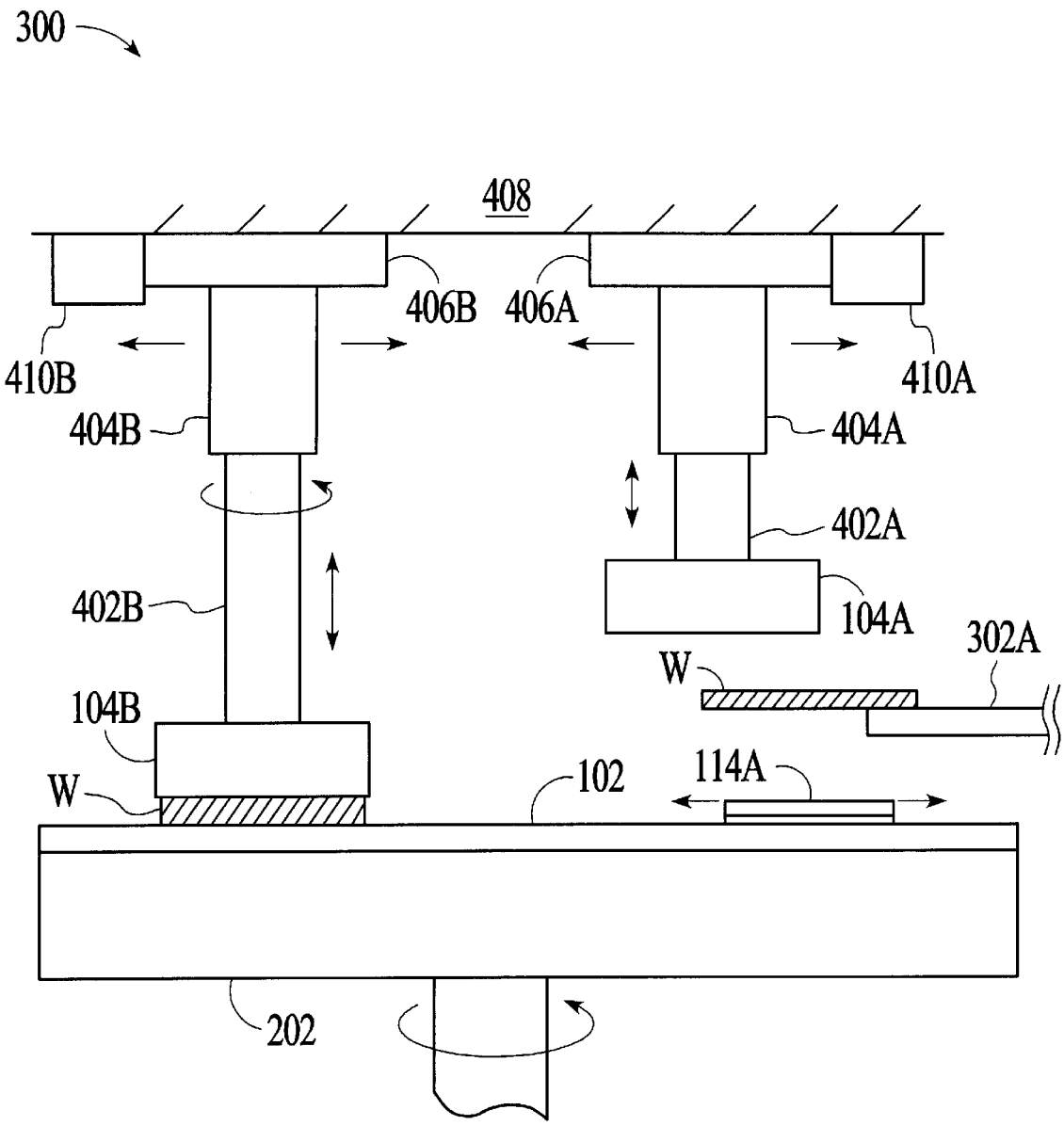
FIG. 4 is side view of the CMP apparatus of FIG. 3.

Turning now to FIGS. 3 and 4, a CMP apparatus 300 in accordance with a second embodiment of the invention is shown. FIG. 3 is a top view of the CMP apparatus 300, while FIG. 4 is a side view of the apparatus. Similar to the CMP apparatus 100 of FIGS. 1 and 2, the CMP apparatus 300 includes the wafer unload/load transfer station 108, the wafer carriers 104A and 104B, the polishing pad 102 and the pad conditioning system 112. However, in this embodiment, the wafer carriers are held in position over the polishing pad and cannot be transferred between the polishing pad and the wafer unload/load transfer station. Thus, the CMP apparatus 300 includes wafer transfer arms 302A and 302B that can transfer semiconductor wafers between the wafer unload/load transfer station and the wafer carriers, as illustrated in FIG. 3. The wafer transfer arms are attached to the arm control mechanisms 212A and 212B, which move the wafer transfers arms to carry semiconductor wafers between the wafer unload/load transfer station and the wafer carriers.

As shown in FIG. 4, the wafer carrier 104A is attached to an arm shaft 402A, which is connected to a rotational-and-vertical drive mechanism 404A. The rotational-and-vertical drive mechanism is configured to rotate the attached wafer carrier 104A by rotating the arm shaft 402A. Furthermore, the rotational-and-vertical drive mechanism 404A is configured to raise and lower the attached wafer carrier 104A by moving the arm shaft 402A along the vertical direction. The rotational-and-vertical drive mechanism 404A is connected to a rail 406A, which is attached to an upper surface 408. The upper surface may be the housing of the CMP apparatus 300. The rail 406A is operatively connected to a lateral drive mechanism 410A, which translates the rotational-and-vertical drive mechanism 404A, the arm shaft 402A and the wafer carrier 104A along the rail 406A. Thus, the lateral drive mechanism 410A is able to laterally oscillate the wafer carrier 104A during polishing of a semiconductor wafer. The wafer carrier 104B is similarly connected to an arm shaft 402B, a rotational-and-vertical drive mechanism 404B, a rail 406B and a lateral drive mechanism 410B. Since the wafer carriers 104A and 104B are attached to different mechanisms, each of the wafer carriers can be independently raised and lowered to engage the polishing pad, and can also be independently rotated to individually polish semiconductor wafers.

The wafer processing operation of the CMP apparatus 300 is similar to the wafer processing operation of the CMP apparatus 100 of FIGS. 1 and 2. Initially, the wafer transfer arms 302A and 302B may be positioned away from the wafer unload/load transfer station 108, as illustrated by the wafer transfer arm 302A in FIG. 3. The wafer processing operation begins when a first semiconductor wafer is received at the wafer unload/load transfer station from an external source, e.g., a wafer cassette. Next, one of the wafer transfer arms, e.g., the wafer transfer arm 302A, is moved by the associated arm control mechanism 212A to transfer the first semiconductor wafer from the wafer unload/load transfer station 108 to the wafer carrier 104A. The first semiconductor wafer is then secured on the bottom of the wafer carrier 104A and polished on the polishing pad 102. As an example, the first semiconductor wafer may be secured to wafer carrier 104A using a vacuum. The first semiconductor is polished by lowering the wafer carrier 104A to engage the first semiconductor wafer to the surface of the polishing pad, during which the wafer is rotated by the wafer carrier 104A and the polishing pad is rotated by the rotatable base 202.

After the first semiconductor wafer is removed from the wafer unload/load transfer station 108 by the wafer transfer arm 302A, a second semiconductor wafer is received at the wafer unload/load transfer station. The other wafer transfer arm, e.g., the wafer transfer arm 302B, is then moved by the arm control mechanism 212B to transfer the second semiconductor wafer from the wafer unload/load transfer station to the wafer carrier 104B. The second semiconductor wafer is then secured on the bottom of the wafer carrier 104B and polished on the polishing pad in the same manner as described above with respect to the first semiconductor wafer.

Similar to the wafer processing operation of the CMP apparatus 100 of FIGS. 1 and 2, the first and second semiconductor wafers are polished on the polishing pad 102 for a predefined polishing period. However, the polishing of the first semiconductor wafer begins prior to the polishing of the second semiconductor wafer. Thus, the polishing period for the first semiconductor wafer is terminated before the polishing period for the second semiconductor wafer. At the end of the polishing period, the first semiconductor wafer is removed from the polishing pad by raising the wafer carrier 104A, and is then transferred from the wafer carrier 104A back to the wafer unload/load transfer station 108 by the wafer transfer arm 302A. The polished first semiconductor wafer is then placed on the wafer unload/load transfer station, where the polished wafer is removed and transmitted to the next destination. After the polished first semiconductor wafer is removed from the wafer unload/load transfer station, a third semiconductor wafer to be polished is received at the wafer unload/load transfer station. The third semiconductor wafer is then transferred from the wafer unload/load transfer station to the wafer carrier 104A by the wafer transfer arm 302A and processed in the same manner as the first semiconductor wafer.

At the end of the polishing period for the second semiconductor, the second wafer is removed from the polishing pad 102 by raising the wafer carrier 104B, and is then transferred back to the wafer unload/load transfer station 108 by the wafer transfer arm 302B. The polished second semiconductor wafer is then placed on the wafer unload/load transfer station, where the polished wafer is removed and transmitted to the next destination. After the polished second semiconductor wafer is removed from the wafer unload/load transfer station, a fourth semiconductor wafer to be polished is received at the wafer unload/load transfer station. The fourth semiconductor wafer is transferred to the wafer carrier 104B by the wafer transfer arm 302B and processed in the same manner as the second semiconductor wafer. In this fashion, the CMP apparatus 300 continually processes two semiconductor wafers in a parallel manner.

Similar to the CMP apparatus 100 of the first embodiment, the polishing pad 102 is conditioned by the pad conditioning system 112 of the CMP apparatus 300 during the wafer processing operation. When the wafer carrier 104A is being loaded with a semiconductor wafer to be polished, the pad conditioner 114A is swept across the polishing pad 102 to condition the pad, as illustrated in FIG. 4. Similarly, when the wafer carrier 104B is being loaded with a semiconductor wafer to be polished, the pad conditioner 114B is swept across the polishing pad to condition the pad. The polishing pad may be conditioned each time one of the wafer carriers is being loaded with a new semiconductor wafer. Alternatively, the polishing pad may be conditioned less frequently. The frequency of the pad conditioning by the pad conditioners may be adjusted as needed.

Figure 5:
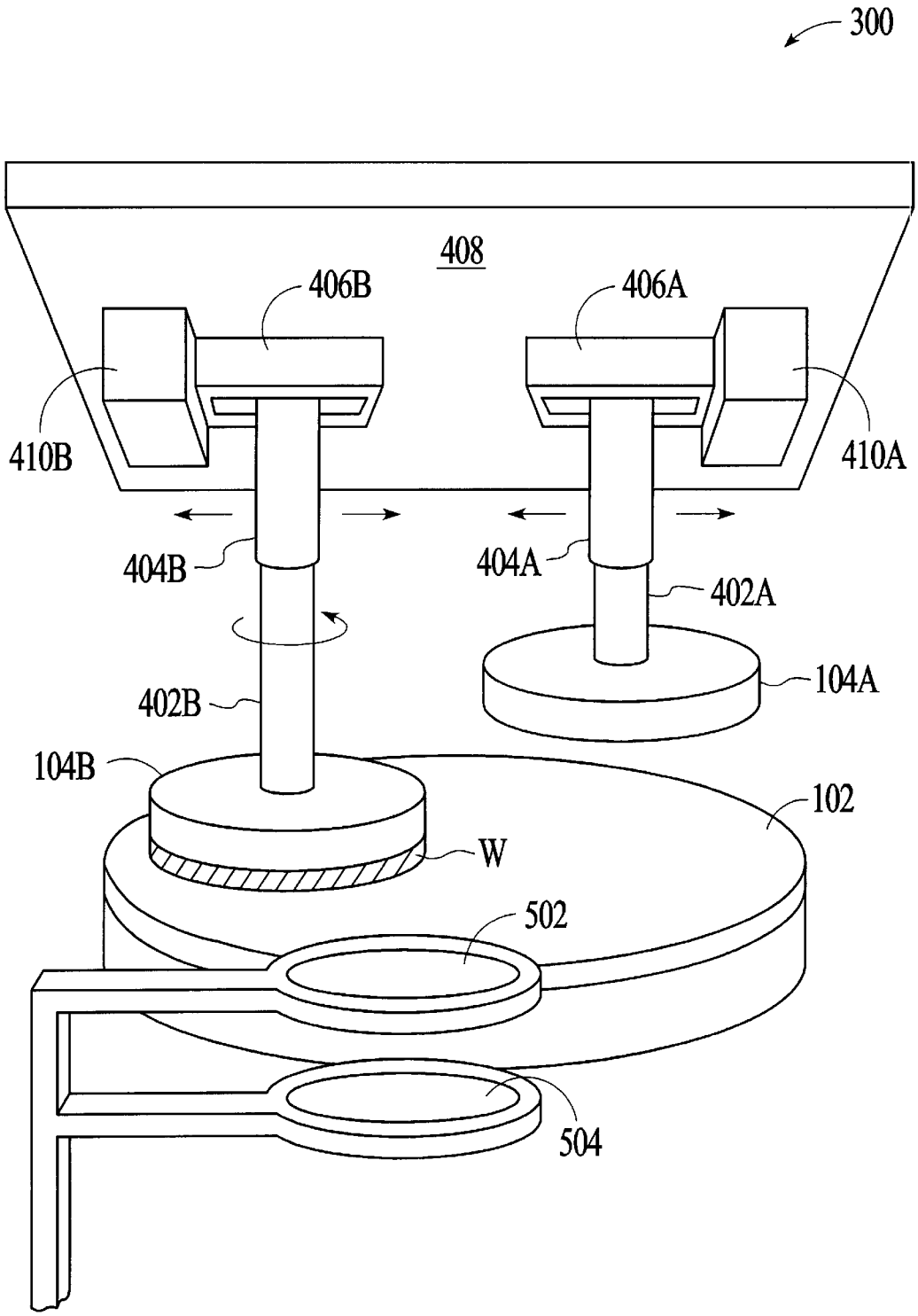
FIG. 5 is a perspective view of the CMP apparatus in accordance with an alternative second embodiment of the invention.

In an alternative second embodiment, the CMP apparatus 300 includes two wafer transfer stations 502 and 504, as illustrated in FIG. 5, instead of the single wafer unload/load transfer station 108. The wafer transfer station 502 is used exclusively as a wafer load station. Thus, only semiconductor wafers that are to be polished by the CMP apparatus 300 are received at the wafer transfer station 502. The received semiconductor wafers are then carried to the wafer carriers 104A and 104B by the wafer transfer arms 302A and 302B (not shown in FIG. 5) for polishing. In contrast, the wafer transfer station 504 is used exclusively as a wafer unload station. Thus, only semiconductor wafers that have been polished by the CMP apparatus 300 are received at the wafer transfer station 502. These polished semiconductor wafers are then removed from the wafer transfer station 504 and transferred to the next destination.

As shown in FIG. 5, the wafer transfer stations 502 and 504 are vertically positioned such that the wafer transfer station 502 is situated directly above the wafer transfer station 504. However, the positions of these wafer transfer stations may be reversed. The configuration of the wafer transfer stations 502 and 504 ensures that the footprint of the CMP apparatus 300 is minimized.

Figure 6:
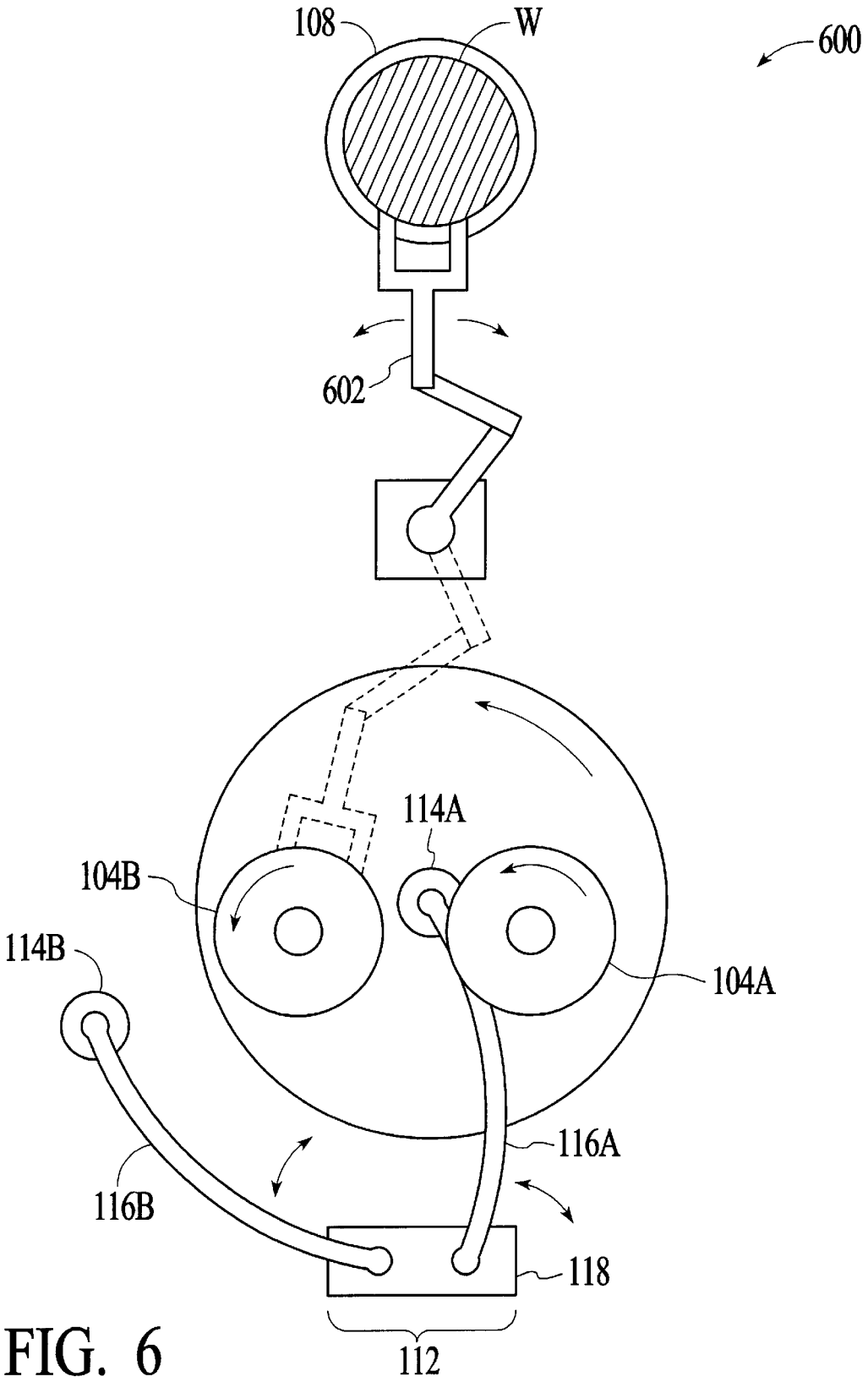
FIG. 6 is top view of a CMP apparatus in accordance with a third embodiment of the invention.

Turning now to FIG. 6, a CMP apparatus 600 in accordance with a third embodiment of the invention is shown. The CMP apparatus 600 is similar to the CMP apparatus 300 of the second embodiment in that the wafer carriers 104A and 104B are held in position over the polishing pad 102. However, the CMP apparatus 600 utilizes a single wafer transfer arm 602 to transfer semiconductor wafers between the wafer unload/load transfer station 108 and the wafer carriers 104A and 104B, as illustrated in FIG. 6. Thus, the wafer transfer arm 602 of the CMP apparatus 600 performs the functions of both wafer transfer arms 302A and 302B of the CMP apparatus 300 of FIGS. 3 and 4.

The wafer processing operation of the CMP apparatus 600 is similar to the wafer processing operation of the CMP apparatus 300. The only significant difference between the two wafer processing operations is that the CMP apparatus 600 utilizes a single wafer transfer arm, i.e., the wafer transfer arm 602, to transfer semiconductor wafers between the wafer unload/load transfer station 108 and the wafer carrier 104A and to transfer semiconductor wafers between the wafer unload/load transfer station and the wafer carrier 104B.

Similar to the CMP apparatus 300 of FIGS. 3 and 4, the CMP apparatus 600 may include the vertically positioned wafer transfer stations 502 and 504, instead of the single wafer unload/load transfer station 108. Thus, in this arrangement, only semiconductor wafers that are to be polished by the CMP apparatus 600 are received at the wafer transfer station 502. The received semiconductor wafers are then carried to the wafer carriers 104A and 104B by the wafer transfer arm 602 for polishing. In addition, only semiconductor wafers that have been polished by the CMP apparatus 600 are received at the wafer transfer station 502. These polished semiconductor wafers are then removed from the wafer transfer station 504 and transferred to the next destination. In an alternative configuration, the wafer transfer stations 502 and 504 may be horizontally positioned such that the upper surfaces of the wafer transfer stations are substantially planar.

Figure 7:
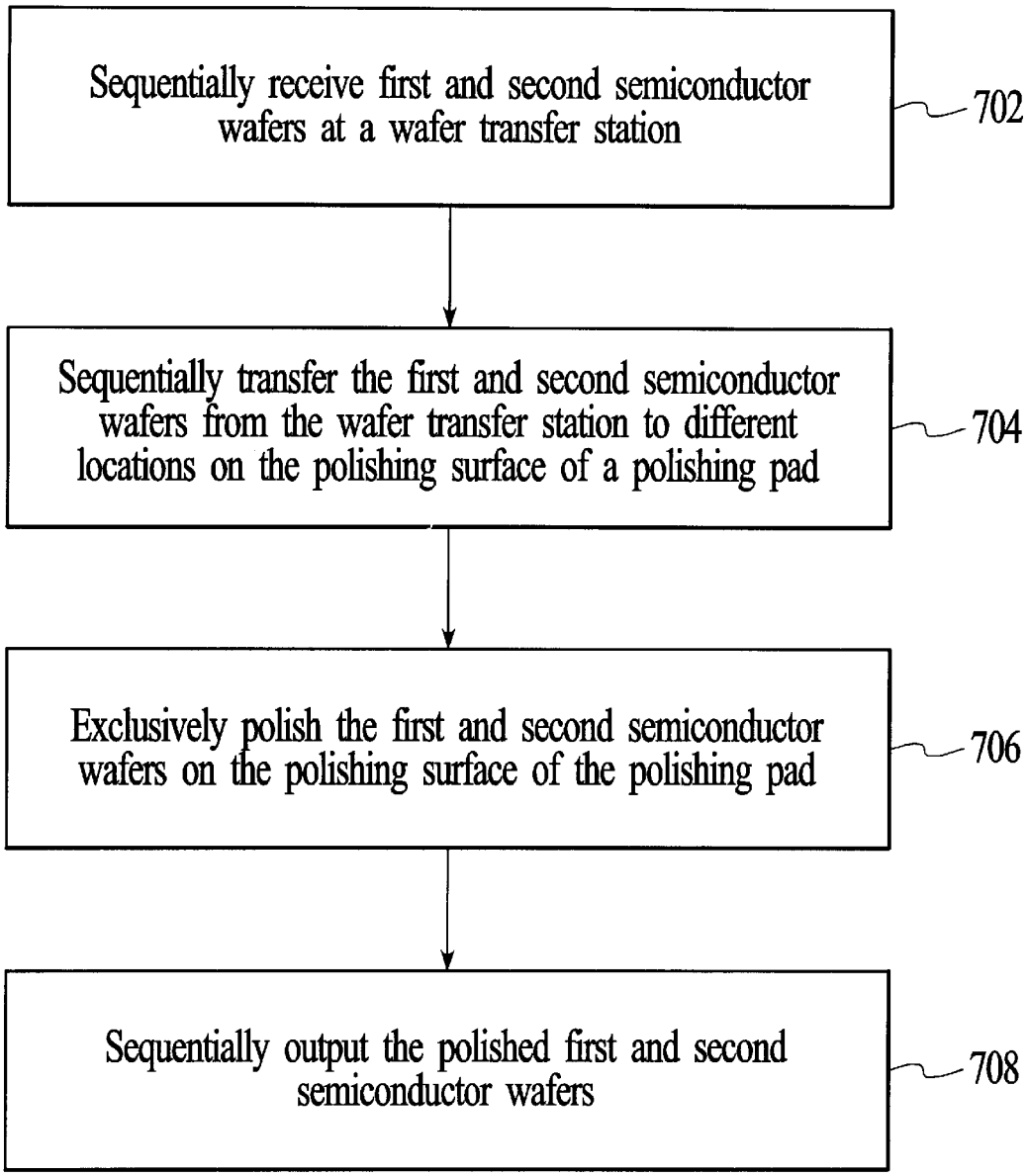
FIG. 7 is a process flow diagram of a method of polishing surfaces of semiconductor wafers in accordance with the present invention.

A method of polishing surfaces of semiconductor wafers in accordance with the present invention is described with reference to FIG. 7. At step 702, first and second semiconductor wafers are sequentially received at a wafer transfer station. Next, at step 704, the first and second semiconductor wafers are sequentially transferred from the wafer transfer station to different locations on the polishing surface of a polishing pad. In one embodiment, the first and second semiconductor wafers are transferred from the wafer transfer station to the polishing pad by wafer carriers. In another embodiment, the first and second semiconductor wafers are transferred from the wafer transfer station to the polishing pad in two stages. During the first stage, the first and second semiconductor wafers are sequentially transferred from the wafer transfer station to the wafer carriers by one or more wafer transfer arms. In this embodiment, the wafer carriers are held over the polishing pad and cannot be moved between the wafer transfer station and the polishing pad. During the second stage, the first and second semiconductor wafers are lowered to the polishing surface of the polishing pad by the wafer carriers. At step 706, the first and second semiconductor wafers are polished on the polishing surface of the polishing pad. Next, at step 708, the polished first and second semiconductor wafers are sequentially output. In one embodiment, the polished first and second semiconductor wafers are transferred back to the original wafer transfer station. In another embodiment, the polished first and second semiconductor wafers are transferred to a different wafer transfers station, which is vertically positioned with respect to the original wafer transfer station. If additional semiconductor wafers are received at the original wafer transfer station, steps 702 through 708 are repeated for the next two semiconductor wafers.

What is claimed is:

1. An apparatus for polishing surfaces of objects comprising:

an object transfer station that is configured to sequentially receive said objects;

a polishing pad having a polishing surface to polish said objects; and means for sequentially transferring said objects between said object transfer station and said polishing pad to exclusively polish said objects on said polishing pad, said sequentially transferring means being configured to transfer at least two current objects of said objects from said object transfer station to different locations on said polishing pad such that said two current objects can be simultaneously polished on said polishing surface of said polishing pad, said sequentially transferring means including a first object carrier and a second object carrier, each of said first and second object carriers being configured to secure one of said objects to be polished, said sequentially transferring means further including a first mechanical arm that is connected to said first object carrier and a second mechanical arm that is connected to said second object carrier, said first mechanical arm being configured to transfer said first object carrier between said object transfer station and said polishing pad, said second mechanical arm being configured to transfer said second object carrier between said object transfer station and said polishing pad, said first and second mechanical arms being configured to independently pivot about fixed axes to transfer said first and second object carriers between said object transfer station and said polishing pad.

2. The apparatus of claim 1 wherein said first and second mechanical arms are configured to rotate said first and second object carriers.

3. The apparatus of claim 2 wherein said first and second mechanical arms are configured to rotate said first and second object carriers at independent rotational speeds.

4. The apparatus of claim 1 wherein said first and second mechanical arms are configured to move said first and second object carriers along a vertical direction that is substantially perpendicular to said polishing surface of said polishing pad.

5. The apparatus of claim 4 wherein said first and second mechanical arms are configured to independently move said first and second object carriers along said vertical direction.

6. The apparatus of claim 1 further comprising a pad conditioning system, said pad conditioning system including a first pad conditioner and a second pad conditioner that are configured to selectively engage said polishing surface of said polishing pad to condition said polishing pad.

7. The apparatus of claim 6 wherein said pad conditioning system includes a first pad conditioning arm and a second pad conditioning arm that are connected to said first and second pad conditioners to independently move said first and second pad conditioners across said polishing surface of said polishing pad.

8. The apparatus of claim 1 further comprising an object unload station that is vertically positioned with respect to said object transfer station, said object unload station being configured to exclusively receive said objects that have been polished.

9. An apparatus for polishing surfaces of objects comprising:

an object transfer station that is configured to sequentially receive said objects;

a polishing pad having a polishing surface to polish said objects;

a first object carrier and a second object carrier that are positioned about said polishing surface of said polishing pad to engage said polishing surface of said polishing pad, each of said first and second object carriers being configured to secure one of said objects to be polished; and means for sequentially transferring said objects between said object transfer station and said polishing pad to exclusively polish said objects on said polishing pad, said sequentially transferring means being configured to transfer at least two current objects of said objects from said object transfer station to different locations on said polishing pad such that said two current objects can be simultaneously polished on said polishing surface of said polishing pad, said sequentially transferring means including a first object transfer arm and a second object transfer arm, said first object transfer arm being configured to exclusively transfer some of said objects between said object transfer station and said first object carrier, said second object transfer arm being configured to exclusively transfer some of said objects between said object transfer station and said second object carrier.

10. The apparatus of claim 9 further comprising a first rotational drive mechanism that is connected to said first object carrier and a second rotational drive mechanism that is connected to said second object carrier, said first and second rotational drive mechanisms being configured to independently rotate said first and second object carriers.

11. The apparatus of claim 9 further comprising a first vertical drive mechanism that is connected to said first object carrier and a second vertical drive mechanism that is connected to said second object carrier, said first and second vertical drive mechanism being configured to independently move said first and second object carriers along a vertical direction that is substantially perpendicular to said polishing surface of said polishing pad.

12. The apparatus of claim 9 further comprising a first lateral drive mechanism that is connected to said first object carrier and a second lateral drive mechanism that is connected to said second object carrier, said first and second lateral drive mechanism being configured to move said first and second object carriers along a lateral direction that is substantially parallel to said polishing surface of said polishing pad.

13. The apparatus of claim 9 further comprising a pad conditioning system, said pad conditioning system including a first pad conditioner and a second pad conditioner that are configured to selectively engage said polishing surface of said polishing pad to condition said polishing pad.

14. The apparatus of claim 13 wherein said pad conditioning system includes a first pad conditioning arm and a second pad conditioning arm that are connected to said first and second pad conditioners to independently move said first and second pad conditioners across said polishing surface of said polishing pad.

15. The apparatus of claim 9 further comprising an object unload station that is vertically positioned with respect to said object transfer station, said object unload station being configured to exclusively receive said objects that have been polished.

* * * * *